US006437520B1

(12) United States Patent
Grouev et al.

(10) Patent No.: US 6,437,520 B1
(45) Date of Patent: Aug. 20, 2002

(54) ELECTRONIC BALLAST WITH CROSS-COUPLED OUTPUTS

(75) Inventors: Gueorgui L. Grouev; Peter W. Shackle, both of Arlington Heights, IL (US)

(73) Assignee: Energy Savings, Inc., Schaumburg, IL (US)

( * ) Notice: Subject to any disclaimer, the term of this patent is extended or adjusted under 35 U.S.C. 154(b) by 0 days.

(21) Appl. No.: 09/613,919

(22) Filed: Jul. 11, 2000

(51) Int. Cl.[7] ..... H05B 41/36

(52) U.S. Cl. ..... 315/291; 315/55; 315/209 R; 315/307

(58) Field of Search ..... 315/55, 291, 294, 315/307, 324, 70, 209 R, 224

(56) References Cited

U.S. PATENT DOCUMENTS 5,747,942 A * 5/1998 Ranganath ..... 315/224
5,973,455 A * 10/1999 Mirskiy et al. ..... 315/105
6,023,132 A * 2/2000 Crouse et al. ..... 315/307
6,137,239 A * 10/2000 Wu et al. ..... 315/291
6,291,944 B1 * 9/2001 Hesterman et al. ..... 315/224

* cited by examiner

*Primary Examiner*—Don Wong
*Assistant Examiner*—Jimmy T. Vu
(74) *Attorney, Agent, or Firm*—Paul F. Wille

(57) ABSTRACT

Gas discharge lamps having filaments at each end thereof are operated in groups according to the power applied to separate line inputs to the ballast. The filaments of the lamps in a first group are powered by a first inverter that provides lamp current to a second group. The filaments of the lamps in the second group are powered by a second inverter that provides lamp current to the first group of lamps. Thus, even if an inverter is turned off, the lamps powered by that inverter are in a pre-heated state for instant starting. Power is coupled to the filaments by a network that is relatively insensitive to changes in frequency.

15 Claims, 3 Drawing Sheets

ELECTRONIC BALLAST WITH CROSS-COUPLED OUTPUTS

CROSS-REFERENCES TO RELATED APPLICATIONS

This application relates to application Ser. No. 09/372,201, filed Aug. 11, 1999, entitled "Electronic Ballast with Selective Load Control," now U.S. Pat. No. 6,137,239 and to application Ser. No. 09/447,333, filed Nov. 22, 1999, entitled "Electronic Ballast with Selective Power Dissipation," now U.S. Pat. No. 6,177,769, both of which are assigned to the assignee of this invention and both of which are incorporated herein by reference.

BACKGROUND OF THE INVENTION

This invention relates to electronic ballasts for gas discharge lamps and, in particular, to an electronic ballast that separately operates two or more lamps under external control.

A gas discharge lamp, such as a fluorescent lamp, is a non-linear load to a power line, i.e. the current through the lamp is not directly proportional to the voltage across the lamp. Current through the lamp is zero until a minimum voltage is reached, then the lamp begins to conduct. In many gas discharge lamps, small filaments at each end of the lamp are made to glow and emit electrons to facilitate starting the lamp. Such lamps are referred to as rapid start or program start lamps. The filaments are typically coated with a material having a low work function, that is, a material that emits electrons profusely when heated, thereby aiding in ionizing the gases within the lamp and reducing the voltage required to start the lamp. Once the lamp conducts, the current will increase rapidly unless there is a ballast in series with the lamp to limit current.

An electronic ballast typically includes a rectifier for changing the alternating current (AC) from a power line to direct current (DC) and an inverter for changing the direct current to alternating current at high frequency, typically 40–65 kHz. Some ballasts include a boost circuit between the rectifier and the inverter. As used herein, a "boost" circuit is a circuit that increases the DC voltage, e.g. from approximately 170 volts (assuming a 120 volt input) to 300 volts or more, for operating a lamp and for providing power factor correction. "Power factor" is a figure of merit indicating whether or not a load in an AC circuit is equivalent to a pure resistance, i.e. indicating whether or not the voltage and current are in phase. It is preferred that the load be the equivalent of a pure resistance (a power factor equal to one).

It is known in the art to control an electronic ballast with a microprocessor. U.S. Pat. 5,680,015 (Bernitz et al.) discloses a ballast for a high intensity discharge lamp wherein a microprocessor controls a driven half-bridge inverter having a series resonant, direct coupled output. U.S. Pat. 5,925,990 (Crouse et al.) discloses controlling a ballast for gas discharge lamps and for monitoring the operation of the lamps.

Despite the technology contained in an electronic ballast, the ballast is only part of a larger system including lamps and fixtures. In many installations, room lighting is controlled by two switches. Typically, one switch operates one of three fluorescent lamps and the other switch operates the remaining two lamps. The intention is that the full light output is not always required and hence energy can be saved by having reduced light output during parts of the day or evening.

Frequently, the way to separately control lamps is by having two three-lamp fixtures operated by three two-lamp ballasts or else have one two-lamp ballast and one four-lamp ballast. Each ballast operates lamps in both fixtures. A frequent arrangement is to have the center lamps in each fixture powered by a two lamp ballast in one of the fixtures. The remaining lamps are either operated by one four-lamp ballast in one fixture or else by a two-lamp ballast in each fixture. These configurations are pre-assembled at the factory in the form of a master fixture, a satellite fixture and a "whip" or connecting conduit that extends between two fixtures. The fixtures and whip are shipped together as components which must be assembled in the manner intended. Further, the operating voltage for each assembly has to be specified in advance.

Shipping these related pieces and assembling them in the field is commonly described as a nightmare. As one can imagine from the number of combinations of components, confusion and mistakes are likely and cost the manufacturers and the contractors large sums of money.

The above-identified, co-pending applications address the problem of separately operating lamps and the solutions work well for instant start lamps. For rapid start lamps, a problem arises in that the filaments should be heated before applying a starting voltage to the lamp. Switching from one lamp to the other two lamps in a three lamp fixture, one can instant start a rapid start lamp simply by applying a sufficiently high voltage but this is hard on the filaments and decreases the life expectancy of the lamp. With preheat, one could program a controller to delay until the lamps are ready to start. This delay would be perceptible and a user might think that the switch or the ballast is defective and shut off all the lamps before the two lamps have had a chance to start. Alternatively, one could switch immediately to the two lamps and plunge the area into darkness momentarily until the lamps ignited. Neither solution is acceptable.

It is well known that marketing is based upon perception, not reality. The perception of delay as a defect is largely an American phenomenon. In Europe, familiarity with rapid start lamps causes an instant start to be seen as a defect because it is recognized that instantly starting a rapid start lamp is not good. Thus, a ballast suitable for both American and European markets must meet contrary perceptions.

Heating the filaments of all the lamps to be ready for any combination of lamp settings is possible but not an efficient solution because the power consumed by the filaments decreases the efficiency of the system and undermines the whole purpose of being able to select less than all the lamps in a fixture.

Typically, lamps are pre-heated by coupling the filaments to a frequency sensitive circuit that couples more power to the filaments at high frequency than at a lower frequency where the lamps normally operate. In this way, power to the filaments reduces automatically after a lamp has ignited. In order to heat the filaments, all the inverters in a ballast having plural inverters would have to be operating, which further decreases the efficiency of the system and undermines the whole purpose being able to select less than all the lamps in a fixture. Alternatively, operating immediately at low frequency (high output voltage) would cause an instant start, which is also undesirable.

In view of the foregoing, it is therefore an object of the invention to provide an electronic ballast that efficiently and selectively controls a plurality of rapid start, gas discharge lamps.

Another object of the invention is to provide an electronic ballast for rapid start lamps that can instantly change state when on.

A further object of the invention is to provide a electronic ballast that includes a single converter and a plurality of inverters, wherein each inverter performs a programmed start of the lamps connected thereto.

Another object of the invention is to provide an electronic ballast for rapid start lamps, the ballast having a plurality of power inputs and a plurality of inverters, wherein the operation of the inverters is controlled by the power inputs.

A further object of the invention is to provide an electronic ballast for selectively controlling plural loads that is acceptable to both American and European markets.

Another object of the invention is to provide an electronic ballast for selectively controlling plural rapid start, gas discharge lamps by delaying starting to simulate a pre-heat period even though the filaments are already warm.

SUMMARY OF THE INVENTION

The foregoing objects are achieved by this invention in which gas discharge lamps having filaments at each end thereof are operated in groups according to the power applied to separate line inputs to the ballast. The filaments of the lamps in a first group are powered by a first inverter that provides lamp current to a second group. The filaments of the lamps in the second group are powered by a second inverter that provides lamp current to the first group of lamps. Thus, even if an inverter is turned off, the lamps powered by that inverter are in a pre-heated state, ready for immediate conduction. For markets adversely sensitive to instant starting, a delay is programmed into the controller for the ballast to simulate a warm-up period, thereby avoiding the appearance of an instant start. Power is coupled to the filaments by a network that is relatively insensitive to changes in frequency.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
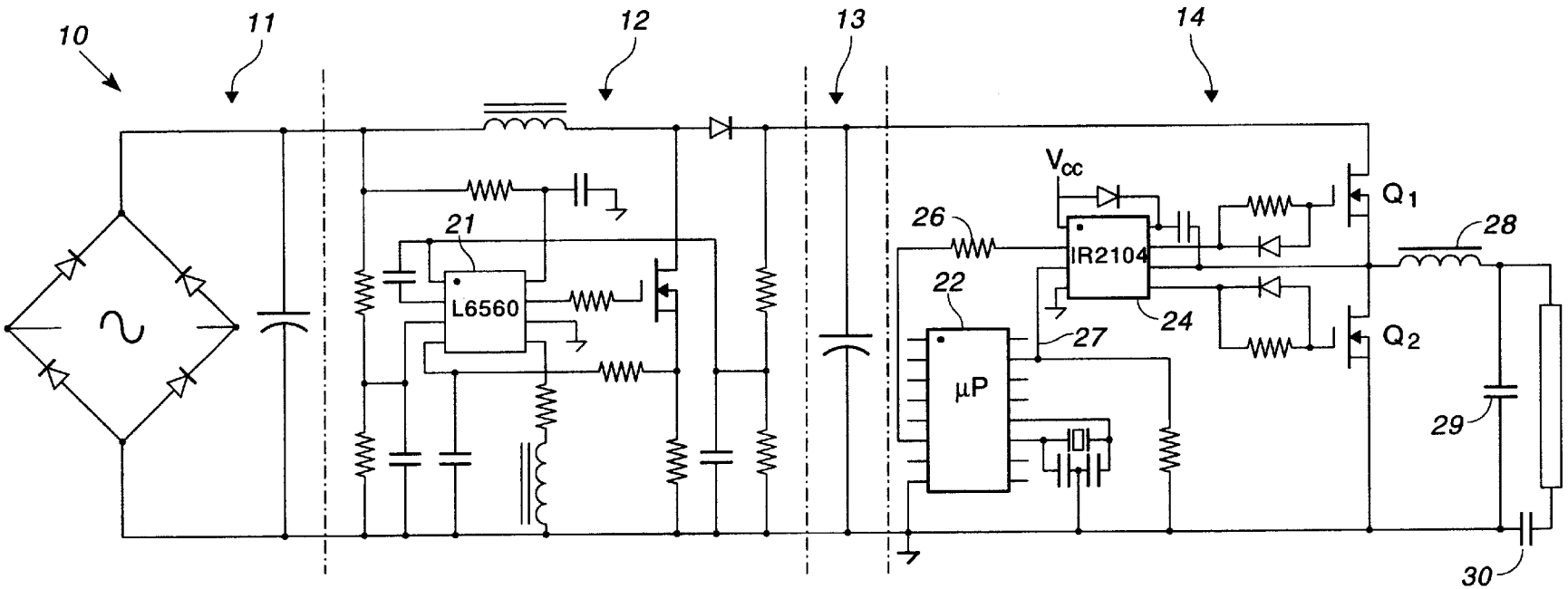
FIG. 1 (PRIOR ART)
FIG. 1 is a schematic of a microprocessor controlled, electronic ballast of the prior art.

FIG. 1 illustrates a microprocessor controlled, electronic ballast constructed in accordance with the prior art. In FIG. 1, pin 1 of each integrated circuit is indicated by a small dot and the pins are numbered consecutively counterclockwise. Ballast 10 includes rectifier section 11 for producing DC from line voltage, boost section 12 for increasing the DC voltage and providing power factor correction, storage section 13 for storing energy to drive a lamp, and inverter section 14 for driving a lamp.

Boost section 12 includes boost controller 21 implemented as an L6560 power factor correction circuit as sold by SGS-Thomson Microelectronics. Boost section 12 is essentially the same as the circuit recommended in the data sheets accompanying the L6560 integrated circuit. Other power factor correction circuits could be used instead.

Energy storage section 13 is illustrated as including a single, so-called "bulk" capacitor. Several bulk capacitors connected in parallel could be used instead. The rectifier, boost, and bulk capacitor together are the "front end" of an electronic ballast, a converter for producing high voltage DC to power inverter 14.

Microprocessor 22 is coupled to two inputs of driver circuit 24. Specifically, high frequency pulses are coupled through resistor 26 through pin 2 of driver 24. Pin 3 of driver 24 is a disable input and is coupled to another output of microprocessor 22. In the event of a fault, disable line 27 is brought low, thereby shutting off the inverter. Inverter 14 includes a half bridge, series resonant, direct coupled output including inductor 28 and resonant capacitor 29. Transistors $Q_1$ and $Q_2$ conduct alternately to connect inductor 28 to high voltage and then to common. Half-bridge capacitor 30 prevents direct current from flowing through one or more lamps coupled to the output and provides an offset voltage for producing symmetrical alternating current through the lamps from the DC pulses at the junction of transistors $Q_1$ and $Q_2$.

Although illustrated as providing power for a single lamp, a ballast such as ballast 10 can provide power for up to four lamps. Powering a single lamp is not cost effective in most applications and does not solve the industry's problem of load control. For the reasons described above, a single ballast powering four lamps simultaneously does not solve the problem either.

Figure 2:
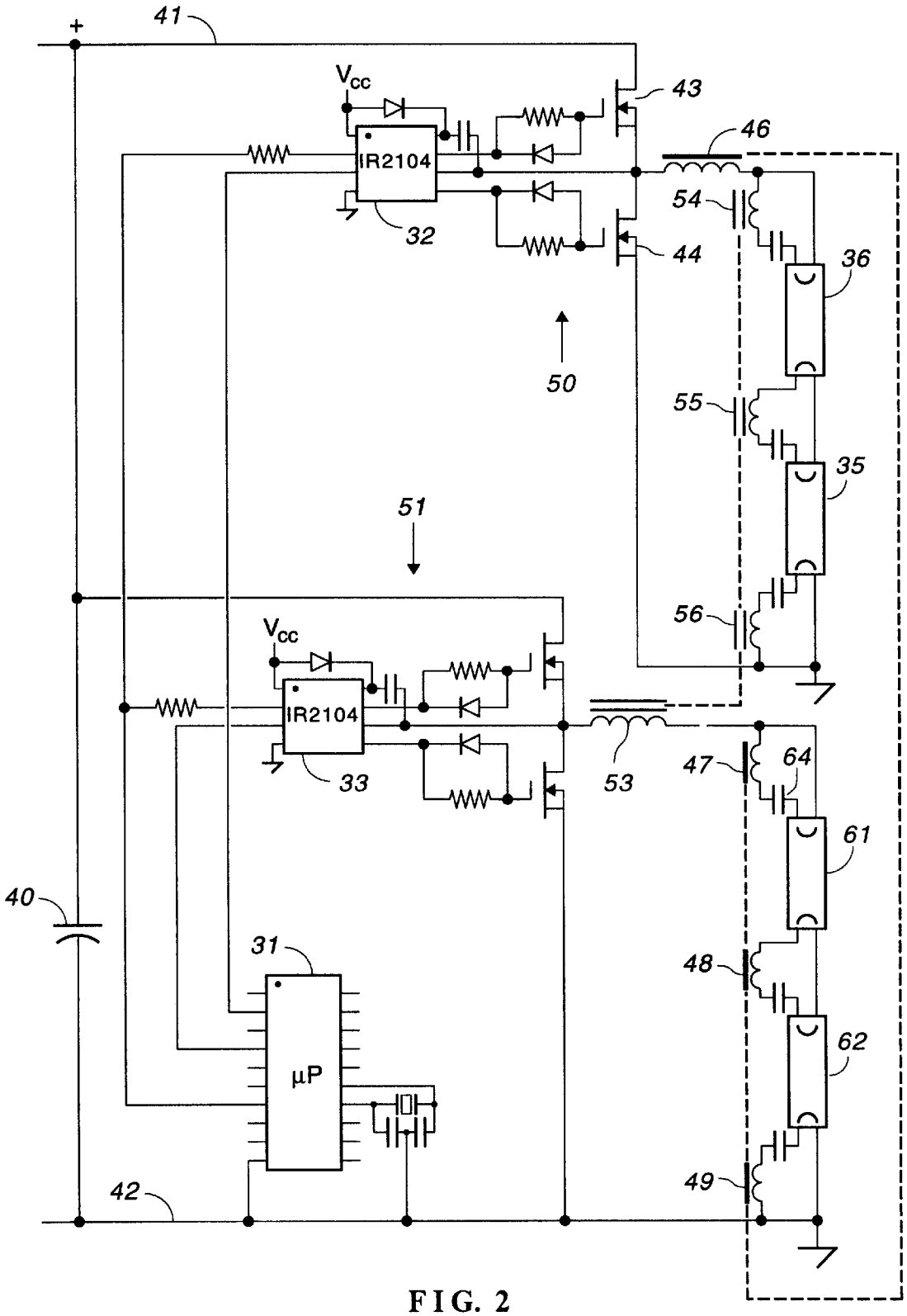
FIG. 2 is a schematic of the inverter section of a ballast constructed in accordance with a preferred embodiment of the invention.

FIG. 2 is a schematic of the inverter section of an electronic ballast constructed in accordance with the invention, wherein the heaters in rapid start lamps are powered by a different inverter from the one supplying current through the lamps. The front end or converter section of the ballast is preferably a resource shared among the several inverters; i.e. all the inverters are connected to a single high voltage rail.

As illustrated in FIG. 2, pin 2 of microprocessor 31 is coupled to pin 3 of driver 32 and pin 4 of the microprocessor is coupled to pin 3 of driver 33. Each driver controls its own half bridge, series resonant, direct coupled output and each output drives either one or two lamps. For example, lamp 35 can be omitted and lamp 36 will continue to function, assuming that lamp 36 is a functional lamp.

High voltage rail 41 is coupled to bulk capacitor 40 and common rail 42 is circuit ground. Transistors 43 and 44 are coupled in series between high voltage rail 41 and common. The junction of transistors 43 and 44 varies between the voltage on rail 41 and common, as described above, for causing a current to flow through series coupled lamps 35 and 36. By-pass capacitors, half-bridge capacitors and other components typically included in an output circuit are omitted for clarity. The inverter controlled by driver 33 operates in the same manner as the inverter controlled by driver 32. Pin 7 of microprocessor 31 provides a clock signal to pin 2 of drivers 32 and 33 that sets the switching frequency of the half-bridge transistors. Control signals from pins 2 and 4 of microprocessor 31 separately enable drivers 32 and 33.

In accordance with one aspect of the invention, resonant inductor 46 is magnetically coupled to heater windings 47, 48 and 49 and resonant inductor 53 is magnetically coupled to heater windings 54, 55, and 56. That is, the heaters associated with lamps driven by a first inverter, inverter 50, are controlled by a second inverter, inverter 51, and vice-versa. In this way, inverter 50 can be running normally with inverter 51 off. Even though inverter 51 is off, lamps 61 and 62 are receiving heater power from inverter 50. Thus, if inverter 51 is enabled, lamps 61 and 62 will immediately conduct.

If the entire fixture is being started from cold, the signal from pin 7 of microprocessor 31 is at pre-heat (high) frequency. As such, there is insufficient voltage to cause the lamps to conduct but power is coupled to the filaments for heating. The output of inverters 50 and 51 are then enabled or disabled to correspond to the output configuration being commanded by the configuration of the line inputs. The signal on pin 7 of microprocessor 31 changes to running (low) frequency and the lamps ignite that are coupled to an enabled inverter. The exact frequencies for starting and running are not part of this invention and depend upon the resonant frequency of the LC output circuit. A start frequency of 80 kHz. and a run frequency of 40 kHz has been found useful. Thus, in accordance with this aspect of the invention, what is known as a "program start" is used for a cold start of one or more lamps coupled to the ballast.

In accordance with a third aspect of the invention, the filament windings have as many as ten times as many turns, up to about twenty turns, as for a filament winding constructed in accordance with the prior art. Current through the winding is limited by making the series capacitor, such as capacitor 64, one tenth the normal size, e.g. as small as 15 nf. Stated another way, the series capacitor has ten times the normal reactance, e.g. at least 100 Ω, at any operating frequency. This combination renders the filament drive relatively independent of frequency and the filaments are heated during preheat and while running.

Figure 3:
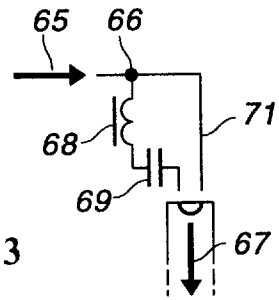
FIG. 3 illustrates the operation of a ballast constructed in accordance with the invention.
Figure 4:
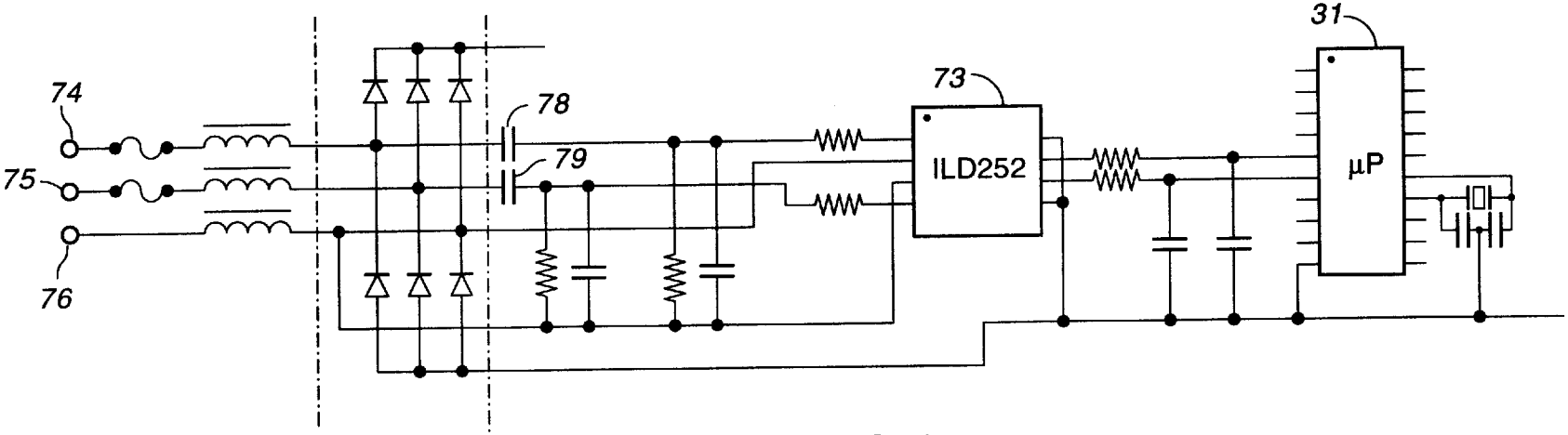
FIG. 4 illustrates the line inputs to a ballast constructed in accordance with the invention.

In a preferred embodiment of the invention, the filament windings are reversely wound for reduced terminal current, as disclosed in U.S. Pat. 5,789,866 (Keith et al.). The relatively high reactance of the series capacitor produces another advantage, as illustrated in FIG. 3. Lamp current 65, not filament current, divides between the two paths available between node 66 and discharge 67 within the lamp. One path includes inductor 68 and capacitor 69. The second path includes wire 71. A filament winding connected in the opposite polarity to the lamp current causes the filament current to oppose the lamp current through the inductor and capacitor. By reducing the capacitance of the series capacitor, one can make the filament current substantially equal to the lamp current. When these two steps are taken, substantially zero current flows through the one pin of the lamp and substantially the entire lamp current flows through the other pin; wire 71 in the embodiment shown in FIG. 3.

The increased reactance of the series capacitor and oppositely poled filament windings provide an advantage in ballasts constructed in accordance with this aspect of the invention. An advantage is that an extremely simple circuit meets the very stringent limitations on terminal current imposed by the lamp manufacturers for some lamps. Other constructions, such as providing switches for controlling filament current, are much more expensive.

In accordance with a fourth aspect of the invention, microprocessor 31 (FIG. 2) is programmed to provide a one second delay to simulate a pre-heat cycle even though a lamp is already pre-heated in accordance with the invention. This simulated or false pre-heat enables a ballast constructed in accordance with the invention to address European markets, where a delay for pre-heating is expected. Thus, if inverter 50 is on and lamps 61 and 62 are receiving filament power, microprocessor 31 waits one second, or some other suitable period, after receiving a signal to turn on inverter 51 before doing so.

Another aspect of the European market is readily addressed by the invention. One might encounter high voltage direct current (DC) rather than alternating current. FIG. 5 illustrates an input constructed as described in the above-identified co-pending applications. Opto-isolator 73 is isolated from line inputs 74 and 75 by capacitors 78 and 79. If a high voltage DC is coupled to either line input, the ballast will begin operation. When microprocessor 31 checks the line inputs, it will see that both are low. In theory, this means that no power is applied. The illogical situation is easily cured in accordance with a fifth aspect of the invention in which microprocessor 31 is programmed to recognize two low line inputs as a DC input, typically used for emergency lighting. Microprocessor 31 is programmed to turn on only one inverter, preferably one coupled to a single lamp, to minimize power consumption.

The invention thus provides an electronic ballast that efficiently and selectively controls a plurality of rapid start, gas discharge lamps. The lamps can be operated in at least two independent groups, as defined by the line inputs, and rapid start lamps change state instantly if any of the lamps have been operating. The ballast performs a programmed start of the lamps when all the lamps have been off and performs a false pre-heat, if desired. Further, the ballast is programmed to recognize a DC input and minimize power consumption while turning on as few lamps as possible.

Having thus described the invention, it will be apparent to those of skill in the art that many modifications can be made with the scope of the invention. For example, if more than two inverters are used, then the lamps can be operated in more than two groups and the groups operated in a predetermined sequence or one group provides pre-heat for more than one other group. On a DC input, microprocessor 31 can be programmed to provide a predetermined maximum amount of power to the fewest lamps, wherein the maximum is less than full power; i.e. the lamp or lamps are dimmed, thereby conserving battery power.

What is claimed as the invention is:

1. An electronic ballast for gas discharge lamps having a filament at each end thereof, said ballast comprising:

two line inputs and a neutral input;

a converter section coupled to said inputs for providing high voltage direct current;

a first inverter and a second inverter coupled to said converter section, wherein each inverter includes an AC output providing high voltage alternating current through a lamp and low voltage alternating current for heating the filament at each end of a lamp;

wherein the first inverter provides low voltage alternating current at the AC output of the second inverter and the second inverter provides low voltage alternating current at the AC output of the first inverter.

2. The ballast as set forth in claim 1 wherein each AC output includes a series resonant inductor and capacitor and a plurality of filament windings, wherein the filament windings in the first inverter are magnetically coupled to the resonant inductor in the second inverter and the filament windings in the second inverter are magnetically coupled to the resonant inductor in the first inverter.

3. The ballast as set forth in claim 2 wherein each AC output includes a capacitor in series with each filament winding.

4. The ballast as set forth in claim 3 wherein each capacitor in series with a filament winding has a reactance of at least 100 Ω at the operating frequency of the ballast.

5. The ballast as set forth in claim 3 wherein each filament winding includes three to twenty turns.

6. The ballast as set forth in claim 2 wherein the filament windings are connected to the outputs with a polarity to minimize terminal current.

7. The ballast as set forth in claim 1 wherein either said first inverter or said second inverter or both inverters are enabled, depending upon which of said line inputs receives power.

8. A method for operating an electronic ballast having at least two line inputs, a neutral input, and two series resonant outputs, the ballast providing power to gas discharge lamps having a filament at each end thereof, said method comprising the steps of:

applying power to at least one line input;

initially providing high frequency voltage at both outputs for a predetermined period to provide low voltage AC for heating the filaments in the lamps coupled to the outputs;

providing low frequency, high voltage for a predetermined time for starting a lamp, said low frequency voltage being applied to any output for which the corresponding line input receives power; and providing high frequency, high voltage to one output while providing high frequency, low voltage to a second output.

9. The method as set forth in claim 8 and further including the steps of:

removing the power from one line input; and providing high frequency, low voltage to the corresponding output.

10. The method as set forth in claim 9 and further including the steps of:

restoring power to the one line input;

waiting a predetermined period;

providing low frequency, high voltage to the corresponding output.

11. The method as set forth in claim 8 wherein said applying step includes the step of applying an alternating current to at least one line input.

12. The method as set forth in claim 8 wherein said applying step includes the step of applying a direct current to at least one line input.

13. The method as set forth in claim 12 wherein said step of providing low frequency, high voltage includes the step of providing low frequency, high voltage to a single output regardless of which line input receives power.

14. A method for operating an electronic ballast having a first output and a second output and including two inverters, wherein each inverter produces lamp current and heater current, said method comprising the steps of:

coupling lamp current from a first inverter to the first output; and coupling filament current from a first inverter to the second output.

15. The method as set forth in claim 14 and further comprising the steps of:

coupling lamp current from the second inverter to the second output; and coupling filament current from the second inverter to the first output.

* * * * *